US005545005A

United States Patent [19]

Stähle

[11] Patent Number: 5,545,005

[45] Date of Patent: Aug. 13, 1996

[54] CENTRIFUGAL PUMP

[76] Inventor: Martin Stähle, Gigeweg 393, 8213 Neunkirch, Switzerland

[21] Appl. No.: 392,774

[22] PCT Filed: Jun. 24, 1994

[86] PCT No.: PCT/CH94/00129

§ 371 Date: Feb. 24, 1995

§ 102(e) Date: Feb. 24, 1995

[87] PCT Pub. No.: WO95/02768

PCT Pub. Date: Jan. 26, 1995

[30] Foreign Application Priority Data

Jul. 16, 1993 [CH] Switzerland ..... 2169/93

[51] Int. Cl.[6] ..... F01D 1/10

[52] U.S. Cl. ..... 415/169.100; 415/175

[58] Field of Search ..... 415/111, 108.1, 415/169.1, 175

[56] References Cited

U.S. PATENT DOCUMENTS

| | | | |
|---|---|---|---|
| 4,256,436 | 3/1981 | Fandrey et al. | 415/175 |
| 5,114,310 | 5/1992 | Haavik et al. | 415/169.1 |
| 5,152,663 | 10/1992 | Peroaho et al. | 415/169.1 |
| 5,215,430 | 6/1993 | Brown | 415/175 |
| 5,413,462 | 5/1995 | Alberni | 415/169.1 |

FOREIGN PATENT DOCUMENTS

| | | | |
|---|---|---|---|
| 0114932 | 8/1984 | European Pat. Off. . | |
| 1426616 | 12/1965 | France . | |
| 1098364 | 1/1961 | Germany | 415/175 |
| 2220875 | 2/1974 | Germany . | |
| 0557472 | 12/1974 | Switzerland | 415/175 |
| 775161 | 5/1957 | United Kingdom . | |
| 8600542 | 1/1986 | WIPO . | |

*Primary Examiner*—Edward K. Look
*Assistant Examiner*—Mark Sgantzos
*Attorney, Agent, or Firm*—Martin A. Farber

[57] ABSTRACT

The impeller (1) is seated with its impeller hub (3) fixed for rotation on a shaft (4). The drive-side edges of the impeller (1), turn with slight clearance (a), over a pump-housing rear wall (5). The latter forms a labyrinth slot 6) with the impeller (1). The labyrinth slot (6) connects the pump chamber (2') with a hub chamber (7). Within the hub chamber (7), a coaxial vane wheel is connected, fixed for rotation, with the impeller (1) in order to impart a stronger rotary movement to the liquid in the hub chamber (7) and centrifuge it. The hub chamber (7) is provided with a peripheral opening (12) for the emergence of the liquid. The air collecting in the region of the shaft (4) escapes through a slot (10) which is formed by the hub housing wall (20) and the shaft (4). The peripheral opening (12) is arranged in the hub-housing wall (20) and developed as a drive nozzle; it debouches into a space (11) adjoining the hub chamber (7) and connected with it by the slot (10) and is directed against the diffuser pipe (13) and forms a liquid jet pump (12, 13) through which the liquid coming from the hub chamber (7) flows.

9 Claims, 1 Drawing Sheet

14
17
15
16
19
13
18
10
20
9
12
6
4
a
11
5
2
2'
1
3
8
7

CENTRIFUGAL PUMP

FIELD AND BACKGROUND OF THE INVENTION

The present invention relates to a centrifugal pump. A type of a centrifugal pump is described, for instance, in EP Patent 114 932.

SUMMARY OF THE INVENTION

The object of the present invention is to improve the separation of gas and liquid in a pump of this type.

According to the invention the peripheral opening (12) is arranged in the hub housing wall (20) and is formed as a drive nozzle; the opening (12) debouches into a space (11) which adjoins the hub chamber (7) on the drive side and is connected with it by the slot (10); the opening (12) is directed against a diffuser pipe (13) in such a manner that it forms a liquid jet pump (12, 13), through which the liquid coming from the hub chamber (7) flows and entrains and discharges the gas coming from the slot (10).

The pressures occurring locally in the pump chamber differ in value depending on the configuration of the impeller and, accordingly, produce different liquid-gas compositions. The object of the invention is to improve the separation of liquid and gas as compared with said prior art, and to do so independently of the configuration of the impeller.

The vanes of the coaxial vane rotor which is connected fixed for rotation with the impeller or the vanes which are fastened with radial symmetry to the hub of the impeller receive the fluid which enters into the hub chamber and place it in intensive rotation. This has the result that the separation of gas and liquid is sharper, since the gas can leave the hub chamber at the smallest diameter (at the shaft clearance slot). The gas leaves the hub chamber before it mixes again with the liquid and can arrive back at the impeller channel due to the unequal pressure conditions in the labyrinth. The separated liquid, on the other hand, is imparted a higher pressure and is driven out through the nozzle of a liquid jet pump. The vacuum produced by the jet of liquid is utilized in order to remove the gases which have been separated. The gas-liquid mixture which emerges from the liquid jet pump can be conducted into a gas-liquid mixture chamber, for example, a gas separator of known construction, from where the liquid is returned into the pump suction line.

BRIEF DESCRIPTION OF THE DRAWING

The invention will be explained by way of example with reference to the accompanying diagrammatic drawing, in which.

DETAILED DESCRIPTION OF THE PREFERRED EMBODIMENT

Figures 1, 2:
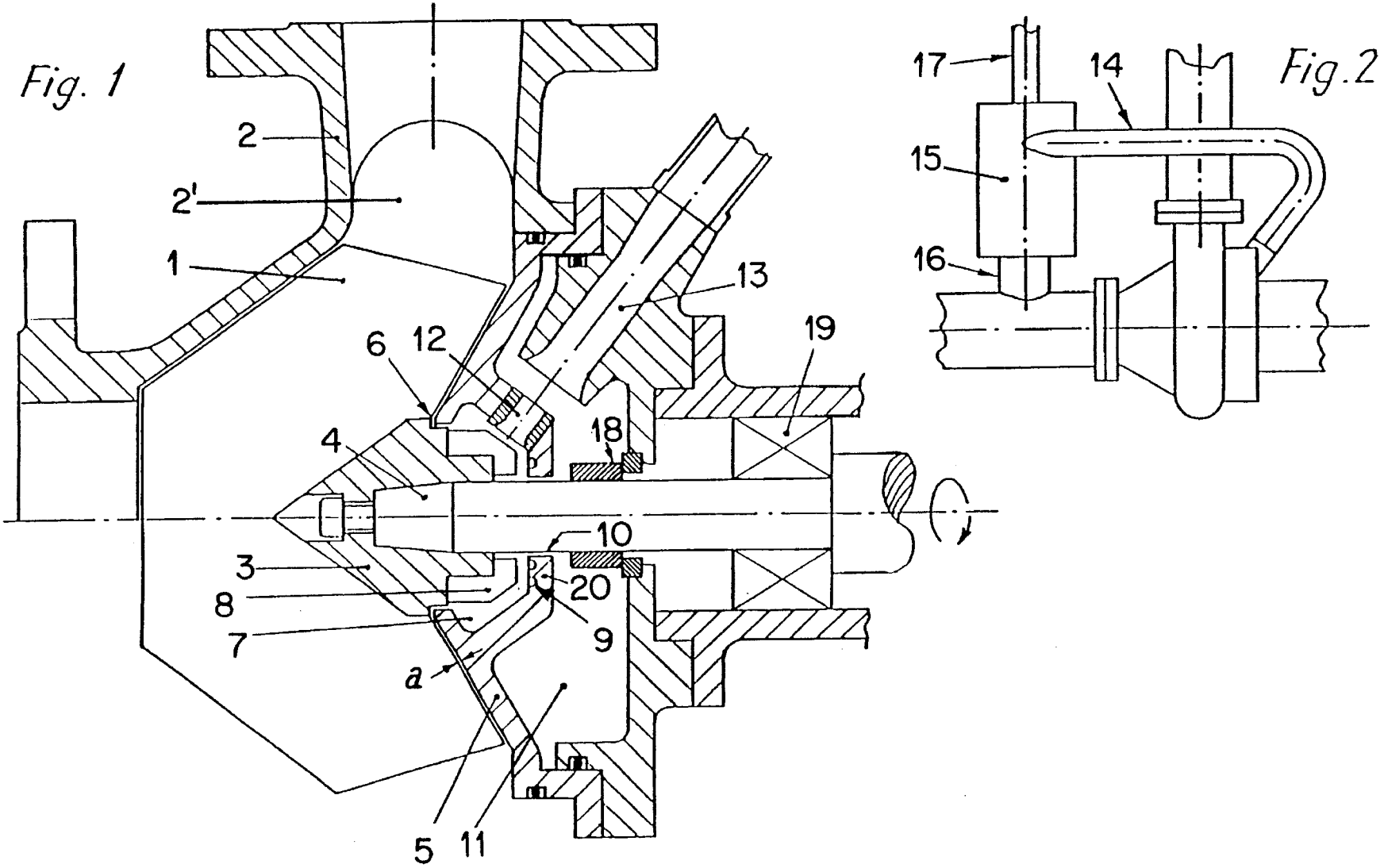
FIG. 1 is a cross-section through a centrifugal pump.
FIG. 2 is a view of the centrifugal pump in a reduced scale.

The centrifugal pump of FIG. 1 has an open, single-vane pump impeller 1 and is mounted for rotation in a pump housing 2. The impeller 1 is seated by means of its hub 3 on a shaft 4 which is mounted in a bearing 19 and turns with slight clearance "a" over the housing rear wall 5 which forms a labyrinth slot 6 with the hub 3 of the impeller 1. The labyrinth slot connects the pump chamber 2' with the hub chamber 7. Gas collected from the material conveyed in the center of the impeller and mixed with liquid passes through the labyrinth slot 6 out of the pump chamber 2' into the hub chamber 7, where it is imparted a stronger rotation by vanes 8 which are attached fixed for rotation to the hub 3. The stronger rotary movement of the gas-liquid mixture results in a better separation between gas and liquid, possible fiber substances being kept away by a guide spiral 9, for example, a spiral groove 9 or a spiral rib arranged in a hub housing wall 20 from a shaft clearance 10 through which the gases can pass into a chamber 11 separated from the hub chamber 7 by the hub housing wall 20. During this, the liquid flows under higher pressure out of the hub chamber 7 through a drive nozzle 12 which passes through the hub housing wall 20 into a diffuser pipe 13 and in this connection entrains the gas out of the chamber 11. A connecting line 14 which connects to the diffuser pipe 13 (FIG. 2) conducts the gas-liquid mixture into a lower pressure chamber such as a gas separator 15 which returns the liquid to the suction-side connection 16 of the centrifugal pump and discharges the gas through a line 17 into a suitable reception space. A shaft packing 18 protects the drive and bearing parts from contact with the material being conveyed.

I claim:

1. A centrifugal pump for conveying suspended solids with a content of gas, comprising an open impeller which has an impeller hub and is seated, fixed for rotation, on a shaft and at least one drive-side vane edge of which turns with slight clearance over a pump housing rear wall which, at an inner diameter thereof forms with the impeller a labyrinth slot which connects a pump chamber with a hub chamber separated on a drive side by a hub housing wall and permits gas collecting in a region of a center of the impeller to emerge as a liquid-gas mixture into the hub chamber while retaining coarse solid particles, and wherein within the hub chamber there is arranged a coaxial vane wheel, which is connected fixed for rotation with the impeller imparting to the liquid in the hub chamber a movement of rotation, and the hub chamber is provided with a peripheral opening for emergence of the liquid and the gas collecting in a region of the shaft escapes on the drive side through a second slot formed by the hub housing wall and the shaft, the peripheral opening is arranged in the hub housing wall and is formed as a drive nozzle;

the opening debouches into a space which adjoins the hub chamber on the drive side and is connected therewith by the second slot;

a diffuser pipe, and wherein the opening is directed against said diffuser pipe constituting therewith a liquid jet pump, through which the liquid coming from the hub chamber flows and entrains and discharges the gas coming from the second slot.

2. The centrifugal pump according to claim 1, wherein the liquid-gas mixture emerging from the liquid jet pump is conducted into a gas-liquid mixture chamber from where the liquid is returned by a connecting line to an inlet of the centrifugal pump and the gas is conducted into a reception space.

3. The centrifugal pump according to claim 1, further comprising vanes of the vane wheel lie opposite to and spaced from a guide spiral which extends outward in a direction of rotation of the shaft and thereby keeps solid particles away from the second slot.

4. The centrifugal pump according to claim 3, wherein said guide spiral is a spiral groove.

5. The centrifugal pump according to claim 3, wherein said guide spiral is a spiral rib.

6. The centrifugal pump according to claim 2, wherein said gas-liquid mixture chamber is a chamber of low pressure.

7. The centrifugal pump according to claim 6, wherein said gas-liquid mixture chamber is a gas separator.

8. A centrifugal pump for conveying suspended solids with a content of gas, comprising an open impeller which has an impeller hub and is seated, fixed for rotation, on a shaft and at least one drive-side vane edge of which turns with slight clearance over a pump housing rear wall which, at an inner diameter thereof forms with the impeller a labyrinth slot which connects a pump chamber with a hub chamber separated on a drive side by a hub housing wall and permits gas collecting in a region of a center of the impeller to emerge as a liquid-gas mixture into the hub chamber while retaining coarse solid particles, and wherein within the hub chamber vanes are fastened with radial symmetry on the impeller hub imparting to the liquid in the hub chamber a movement of rotation, and the hub chamber is provided with a peripheral opening for emergence of the liquid and the gas collecting in a region of the shaft escapes on the drive side through a second slot formed by the hub housing wall and the shaft, the peripheral opening is arranged in the hub housing wall and is formed as a drive nozzle;

the opening debouches into a space which adjoins the hub chamber on the drive side and is connected therewith by the second slot;

a diffuser pipe, and wherein the opening is directed against said diffuser pipe constituting therewith a liquid jet pump, through which the liquid coming from the hub chamber flows and entrains and discharges the gas coming from the second slot.

9. The centrifugal pump according to claim 8, wherein said vanes fastened to the impeller hub lie opposite to and spaced from a guide spiral which extends outward in a direction of rotation of the shaft and thereby keeps solid particles away from the second slot.

* * * * *